US008607409B2

(12) United States Patent
Han

(10) Patent No.: US 8,607,409 B2
(45) Date of Patent: Dec. 17, 2013

(54) SEALING MEMBER FOR DUST SEPARATING APPARATUS

(75) Inventor: Jung-gyun Han, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 710 days.

(21) Appl. No.: 12/703,993

(22) Filed: Feb. 11, 2010

(65) Prior Publication Data

US 2010/0263163 A1 Oct. 21, 2010

(30) Foreign Application Priority Data

Apr. 21, 2009 (KR) ..... 10-2009-0034452

(51) Int. Cl.
*A47L 9/10* (2006.01)

(52) U.S. Cl.
USPC ..... 15/353

(58) Field of Classification Search
USPC ..... 15/327.2, 352, 353
See application file for complete search history.

(56) References Cited

U.S. PATENT DOCUMENTS

| | | | | |
|---|---|---|---|---|
| 7,722,693 | B2 * | 5/2010 | Yoo et al. | 55/345 |
| 2005/0229355 | A1 | 10/2005 | Crouch et al. | |
| 2006/0123590 | A1 * | 6/2006 | Fester et al. | 15/353 |
| 2007/0084165 | A1 | 4/2007 | Nakai et al. | |

FOREIGN PATENT DOCUMENTS

| | | |
|---|---|---|
| JP | 2003-024252 | 1/2003 |
| JP | 2003-190050 | 7/2003 |
| JP | 2008-000391 | 1/2008 |

* cited by examiner

*Primary Examiner* — Robert Scruggs
(74) *Attorney, Agent, or Firm* — NSIP Law

(57) ABSTRACT

A sealing member for reducing or preventing loss of air from a multi-cyclone dust separating apparatus in a vacuum cleaner is provided. A sealing member comprises an inner sealing portion for maintaining sealing between a first cyclone unit and second cyclone units, an outer sealing portion for reducing or preventing the inflow of air to the cyclone dust separating apparatus from its exterior, and a cyclone receiving portion connected to the inner and outer sealing portions by a connecting member. The cyclone receiving portion includes holes in which at least portions of the second cyclone units are respectively received.

5 Claims, 4 Drawing Sheets

SEALING MEMBER FOR DUST SEPARATING APPARATUS

CROSS-REFERENCE TO RELATED APPLICATIONS

This application claims the benefit under 35 U.S.C. §119(a) of a Korean Application No. 10-2009-0034452, filed Apr. 21, 2009, in the Korean Intellectual Property Office, the entire disclosure of which is incorporated herein by reference for all purposes.

BACKGROUND

1. Field

The following description generally relates to a sealing member for a multi-cyclone dust separating apparatus, and more particularly, to a multi-cyclone dust separating apparatus in a vacuum cleaner.

2. Description of the Related Art

Vacuum cleaners having various structures and shapes have been developed and used. Vacuum cleaners having a cyclone dust separating apparatus have been increasingly used. Here, the cyclone dust separating apparatus is used to centrifugally separate dust or dirt from an air stream.

The air suction power may be maintained by a driving motor so that air sucked by a driving motor maintains a flow path in a dust separating apparatus, and dirt and/or dust is collected through the centrifugal force by rotating the air in a cyclone unit. In certain cases, more than one cyclone unit may be provided. Here, sealing is required to prevent air from being leaked between the respective cyclone units in the dust separating apparatus.

However, when sealing is performed with respect to the combination part of each of the cyclone units, for which the sealing is necessary, separate sealing members are individually manufactured, and therefore, cost and failure rate may be increased. Further, vibrations generated when driving the motor may be delivered to some of the sealing members, so that the sealing members may be detached. Therefore, the reliability of the sealing is reduced.

SUMMARY

In one general aspect, there is provided a sealing member to seal against loss of air from a multi-cyclone dust separating apparatus in a vacuum cleaner. The sealing member comprises an inner sealing portion for maintaining sealing between a first cyclone unit and second cyclone units, an outer sealing portion for preventing the inflow of air to the cyclone dust separating apparatus from its exterior, and a cyclone receiving portion connected to the inner and outer sealing portions by a connecting member, the cyclone receiving portion having holes in which at least portions of the second cyclone units are respectively received.

The inner sealing portion may include concave grooves, respectively formed in upper and lower directions.

The outer sealing portion may include a projection formed in at least one of upper and lower directions at a predetermined distance from an end of the connecting member.

The cyclone receiving portion may include a hole rim with a predetermined thickness, extending in at least one of the upper and lower directions from the connecting member, and the hole may include an inner diameter narrowed as it goes from top to bottom, wherein at least a portion of the second cyclone unit is received in the hole.

The hole rim may further include a groove formed in a contact surface of the hole rim, the contact surface contacting an outer circumferential surface of the second cyclone unit.

The sealing member may be formed of an elastic material.

In another aspect, a sealing member for a multi-cyclone dust separating apparatus in a vacuum cleaner is provided. The sealing member includes at least one through hole having a first diameter and at least one hole having a smaller diameter than the first diameter of the through hole.

At least a portion of a cyclone unit may be received in the hole.

The at least one hole may be at least two holes formed at the same distance from the through hole.

The at least one hole may at least two holes, the holes being radially formed at the same distance from the center of the through hole.

In still another aspect, there is provided a sealing member for a multi-cyclone dust separating apparatus in a vacuum cleaner, the multi-cyclone dust separating apparatus comprising a first cyclone generating space, a second cyclone dust collecting chamber, and a second cyclone unit installation space. The sealing member isolates the first cyclone generating space from an internal space of the second cyclone dust collecting chamber, isolates the first cyclone generating space from the second cyclone unit installation space, and isolates the internal space of the second cyclone dust collecting chamber from the exterior of the dust separating apparatus.

The sealing member may further isolate the internal space of the second cyclone dust collecting chamber from the second cyclone unit installation space.

The sealing member may be formed in the shape of a ring as a whole and be doughnut shaped.

In yet another aspect, there is provided a multi-cyclone dust separating apparatus in a vacuum cleaner, the multi-cyclone apparatus including a sealing member comprising at least one through hole having a first diameter and at least one hole having a smaller diameter than the first diameter of the through hole. The sealing member is positioned such an exhaust pipe of the multi-cyclone apparatus extends through the at least one through hole having a first diameter.

At least a portion of a cyclone unit may be received in the hole.

Other features and aspects will be apparent from the following detailed description, the drawings, and the claims.

Figure 1:
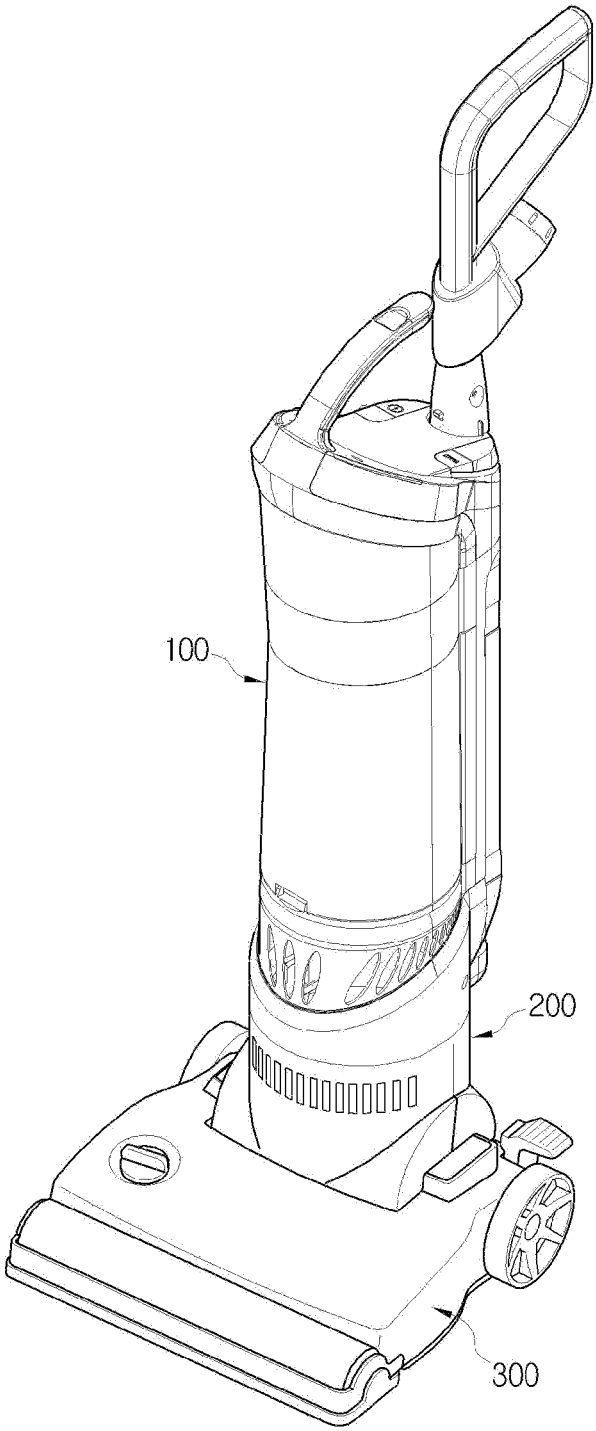
FIG. 1 is a perspective view illustrating an example of a vacuum cleaner having a multi-cyclone dust separating apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatus, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Figure 2:
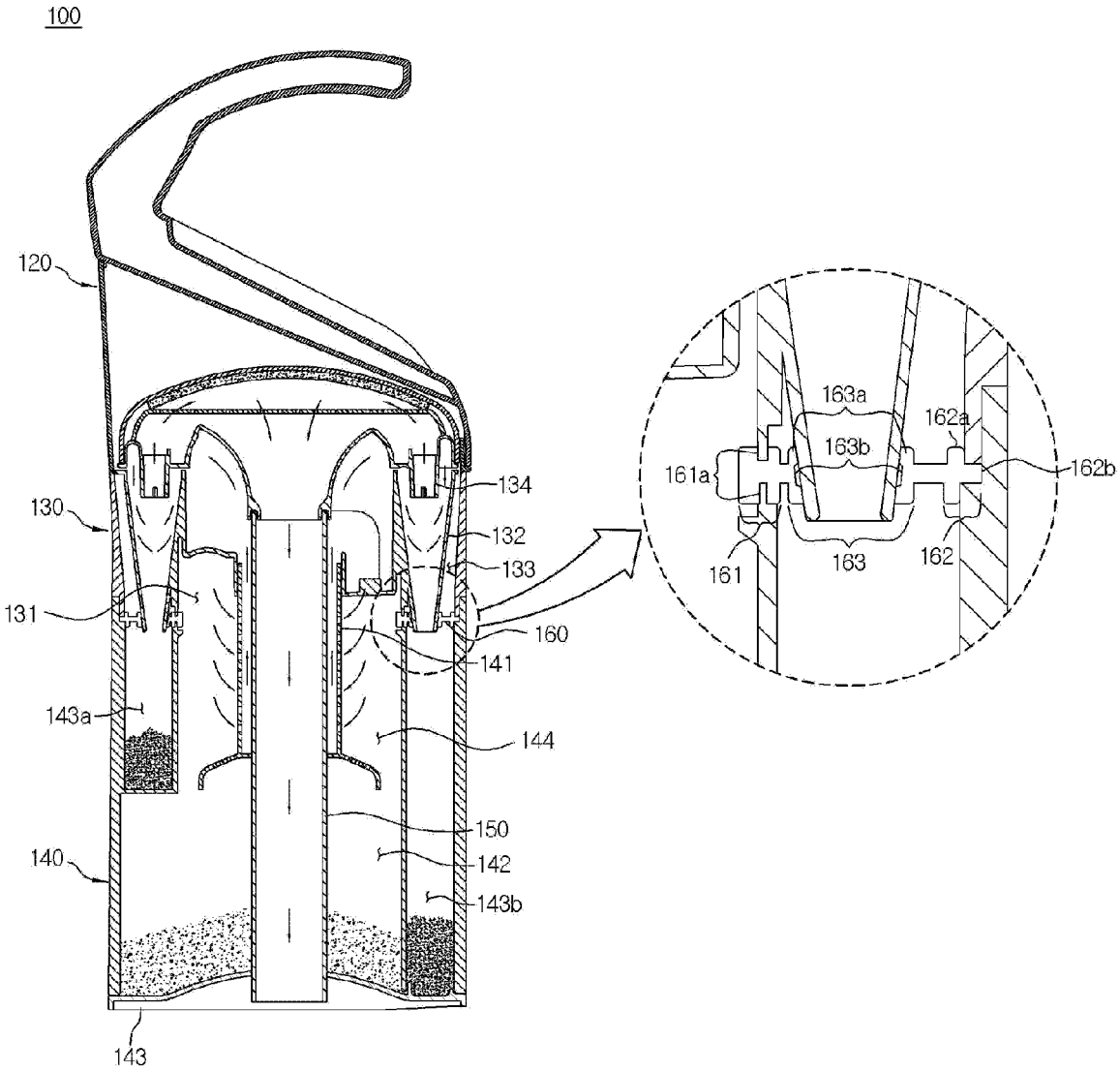
FIG. 2 is a sectional view illustrating an example of the multi-cyclone dust separating apparatus.

FIGS. 1 and 2 illustrate perspective and schematic sectional views, respectively, of an example of a vacuum cleaner having a multi-cyclone dust separating apparatus 100 to which a sealing member 160 is applied.

The vacuum cleaner comprises a dust separating apparatus 100, a vacuum cleaner body 200 and a suction brush 300.

Figure 3:
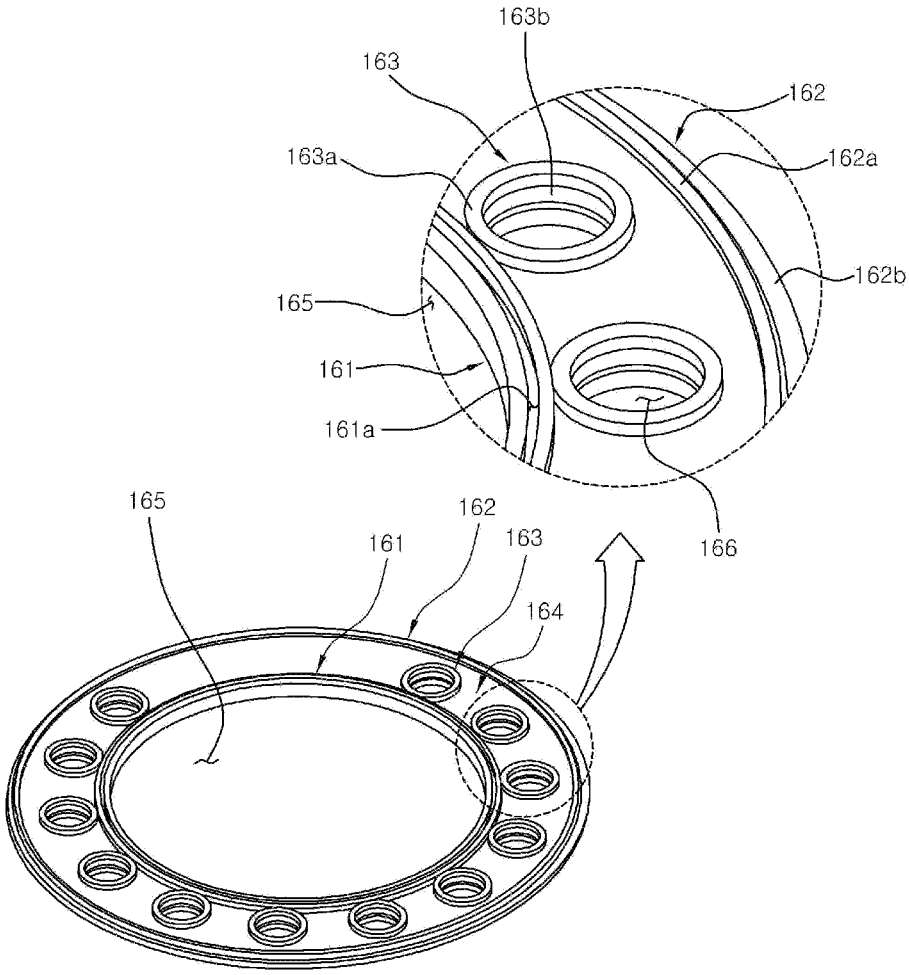
FIG. 3 is a perspective view illustrating an example of a sealing member according to the present invention.
Figure 4:
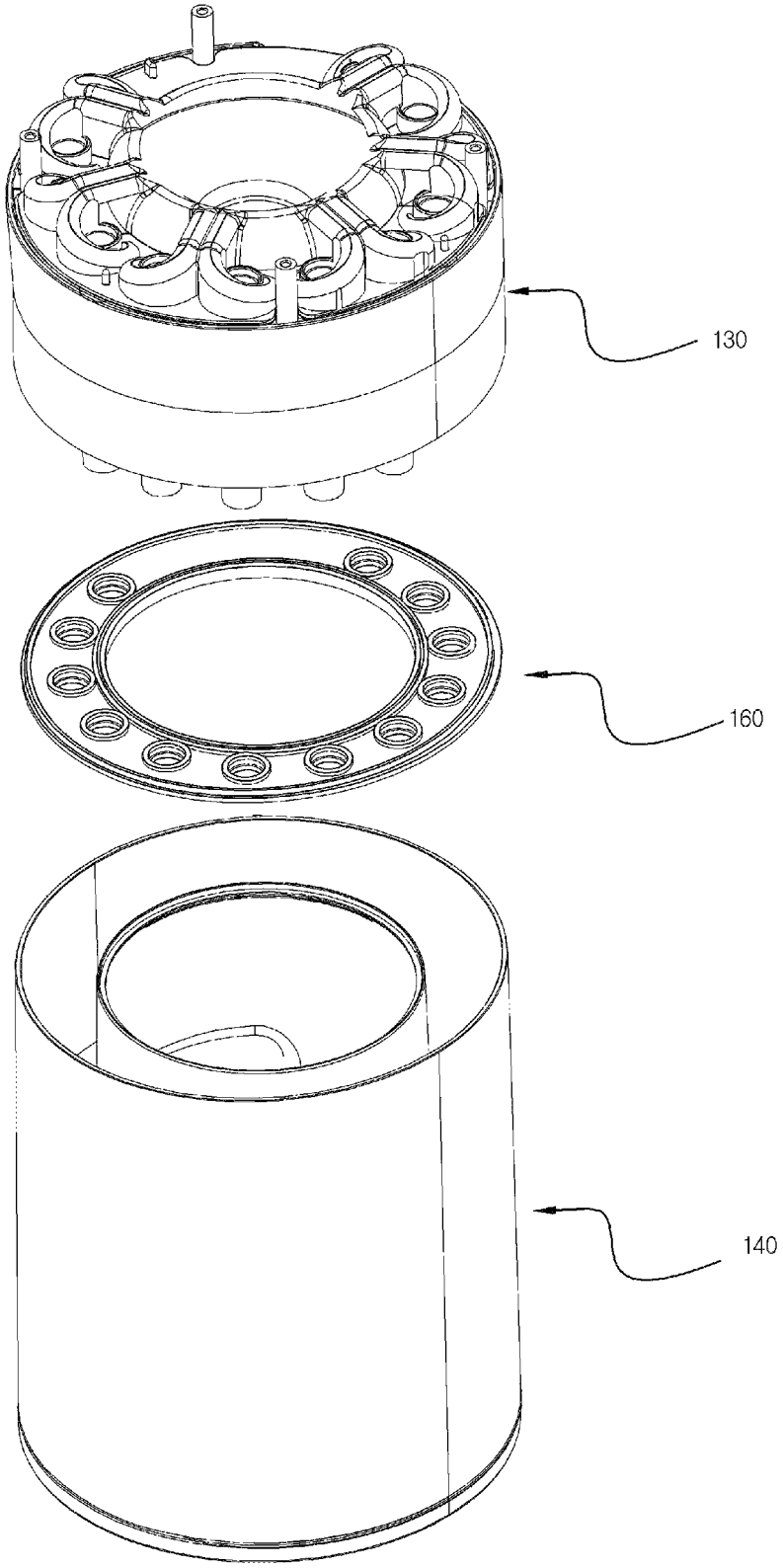
FIG. 4 is an exploded perspective view illustrating an example of a cyclone unit having the sealing member embedded therein.

FIG. 3 illustrates a perspective view showing an example of the sealing member 160 for the dust separating apparatus. FIG. 4 illustrates an exploded perspective view showing an example of an upper body 130 and a lower body 140, between which the sealing member 160 is mounted.

The structure of the multi-cyclone dust separating apparatus and the flow path of an internal air stream is described below with reference to the accompanying drawings to illustrate examples.

The dust separating apparatus 100 having the sealing member 160 may be divided into an upper cover 120, an upper body 130 and a lower body 140. The upper body 130 comprises an air inlet 131 and a plurality of second cyclone units 132. The lower body 140 comprises a first cyclone unit 141, a first cyclone dust collecting chamber 142, second cyclone dust collecting chambers 143*a* and 143*b*, and a lower cover 143. An air exhaust pipe 150 is formed at the center of the dust separating apparatus 100.

The flow path of air is described below. Air sucked by the suction brush 300 forms the internal air stream within the dust separating apparatus 100. The internal air stream first flows into the first cyclone unit 141 and is circulated. At this time, dirt having a relatively large size may be centrifugally separated and then collected into the first cyclone dust collecting chamber 142 positioned below the first cyclone unit 141. Subsequently, the internal air stream flows into the plurality of the second cyclone units 132 and circulated. At this time, dirt having a relatively small size may be centrifugally separated and then collected into the second cyclone dust collecting chambers 143*a* and 143*b* positioned below the second cyclone units 132.

The internal air stream, from which the dirt has been centrifugally separated in the plurality the plurality of second cyclone units 132, is exhausted upward through a plurality of outlets 134 respectively formed at upper portions of the second cyclone units 132 and then escaped from the cyclone dust separating apparatus 100 through the air exhaust pipe 150.

Sealing for restricting inflow of air may be useful along the flow path of the air at the following parts: a first part between a first cyclone generating space 144 and an internal space of the second cyclone dust collecting chamber 143*a* and 143*b*, a second part between the first cyclone generating space 144 and a second cyclone unit installation space 133, a third part between the internal space of the second cyclone dust collecting chamber 143*a* and 143*b* and the exterior of the dust separating apparatus 100, and a fourth part between the internal space of the second cyclone dust collecting chamber 143*a* and 143*b* and the second cyclone unit installation space 133.

The sealing member 160 for the dust separating apparatus, which may simultaneously seal these four parts, is illustrated in FIG. 3, for example.

Referring to the examples shown in FIGS. 2 and 3, the sealing member 160 may be divided into an inner sealing portion 161 and an outer sealing portion 162 about a cyclone receiving portion 163. The inner and outer sealing portions 161 and 162 are connected to each other by a connecting member 164.

The sealing member 160 may be formed in the shape of a ring as a whole and may also have a doughnut shape. A through hole 165 for passing the first cyclone unit 141 therethrough is formed at the center of the sealing member 160. A plurality of holes 166 in a cyclone receiving portion is radially formed at the same distance from the center of the through hole 165. The cyclone receiving portion is connected to the inner and outer sealing portions by the connecting member 164.

Portions of the second cyclone units 132 are respectively received in the holes 166. The number of holes 166 may be formed corresponding to the number of the second cyclone units 132.

The inner sealing portion 161 may be used to seal a combination part between the first and second cyclone units 141 and 132. Preferably, concave grooves 161*a* extending from the connecting member 164 are respectively formed in upper and lower directions so that ends of the upper and lower bodies 130 and 140 in the dust separating apparatus 100 may be insertedly combined with each other. The concave grooves 161*a* may be formed on the inner portion 161.

The outer sealing portion 162 may be used to prevent the inflow of air to the dust separating apparatus 100 from its exterior. The outer sealing portion 162 has projections 162*a* respectively formed upward and downward so that the projections 162*a* may be surface-adhered to walls of the upper and lower bodies 130 and 140 of the dust separating apparatus 100 when they are joined together. An extending portion 162*b* extending to the right from the connecting member 164 is formed to be inserted and pressurized between the upper and lower bodies 130 and 140 of the dust separating apparatus 100 when they are joined together.

The cyclone receiving portion 163 is formed between the inner and outer sealing portions 161 and 162. The cyclone receiving portion 163 comprises at least one hole 166 as described above.

When an end portion of the second cyclone unit 132 is formed in a cone shape as illustrated in FIG. 2, for example, the inside diameter of the hole 166 is also narrowed as it goes from top to bottom, thereby broadening the contact area of the second cyclone unit 132 with the hole 166.

As illustrated in FIG. 3, for example, a hole rim 163*a* with a proper thickness, extending in upper and lower directions from the connecting member 164, may be formed so that the sealing performance is improved. The inner diameter of the hole 166 having the hole rim 163*a* is also narrowed as it goes from top to bottom.

Preferably, a groove 163*b* is formed at the center of a contact surface of the hole rim 163*a* with an outer circumferential surface of the second cyclone unit 132 so that the section of the groove 163*b* roughly has a "⊏" shape. Accordingly, the contact surface of the hole rim 163*a* with the outer circumferential surface of the second cyclone unit 132 may be doubly formed, thereby improving sealing efficiency.

A material such as a synthetic rubber or urethane with elasticity may be used as the material of the sealing member 160. Use of such a material may thereby improve sealing effect through compression of the sealing member 160 with the cyclone units. However, these materials are intended to only represent an example of suitable materials. The material from which the sealing member is made is not limited to these examples, as other suitable materials may be used.

When the sealing member 160 is formed of an elastic material, it has an elastic force. Hence, when the lower body 140 is separated to remove dust collected into the dust collecting chambers of the dust separating apparatus 100, the sealing member 160 is inserted and fixed between the end of the upper body 130 and the second cyclone units 132, so that there is reduced or no inconvenience that the sealing member 160 comes off when the dust collecting chambers are cleansed.

As described above, the sealing member 160 may simultaneously seal a part between a first and second cyclone dust collecting chambers, a part between the second cyclone dust collecting chamber and the exterior of a dust separating apparatus, and a part between the outlet of a second cyclone unit and a first cyclone generating space.

Further, the sealing member 160 may simultaneously seal a part between a second cyclone unit installation space and an internal space of the second cyclone dust collecting chamber.

Accordingly, when sealing combination parts between cyclone units, an integrated sealing member capable of simultaneously sealing several parts is formed, so that improved sealing can be achieved through ease of manufacture, improvement of productivity, lowering of failure rate, for example. Other advantages may be recognized as well.

A number of examples of embodiments have been described above. Nevertheless, it will be understood that various modification may be made. For example, suitable results may be achieved if the described techniques are performed in a different order and/or if components in a described system, architecture, device, circuit or apparatus are combined in a different manner and/or replaced or supplemented by other components or their equivalents. Accordingly, other implementations are within the scope of the following claims.

What is claimed is:

1. A sealing member to seal against loss of air from a multi-cyclone dust separating apparatus in a vacuum cleaner, the sealing member comprising:

an inner sealing portion for maintaining sealing between a first cyclone unit and second cyclone units;

an outer sealing portion for preventing the inflow of air to the cyclone dust separating apparatus from its exterior; and a cyclone receiving portion connected to the inner and outer sealing portions by a connecting member, the cyclone receiving portion having holes in which at least portions of the second cyclone units are respectively received, wherein the inner sealing portion has concave grooves, respectively formed in upper and lower directions.

2. The sealing member of claim 1, wherein the outer sealing portion has a projection formed in at least one of upper and lower directions at a predetermined distance from an end of the connecting member.

3. The sealing member of claim 2, wherein the cyclone receiving portion has a hole rim with a predetermined thickness, extending in at least one of the upper and lower directions from the connecting member, and the hole has an inner diameter narrowed as it goes from top to bottom, wherein at least a portion of the second cyclone unit is received in the hole.

4. The sealing member of claim 3, wherein the hole rim further comprises a groove formed in a contact surface of the hole rim, the contact surface contacting an outer circumferential surface of the second cyclone unit.

5. The sealing member of claim 1, wherein the sealing member is formed of an elastic material.

* * * * *